US009546542B2

(12) United States Patent
Colomé

(10) Patent No.: US 9,546,542 B2
(45) Date of Patent: Jan. 17, 2017

(54) METHOD OF EXPLOITING POTASSIUM SALTS FROM AN UNDERGROUND DEPOSIT

(71) Applicant: VALE S.A., Centro, Rio de Janeiro (BR)

(72) Inventor: Jaime Daniel Colomé, San Juan (AR)

(73) Assignee: VALE S.A., Rio de Janeiro (BR)

( * ) Notice: Subject to any disclaimer, the term of this patent is extended or adjusted under 35 U.S.C. 154(b) by 0 days.

(21) Appl. No.: 14/406,116

(22) PCT Filed: Jun. 4, 2013

(86) PCT No.: PCT/BR2013/000195

§ 371 (c)(1),
(2) Date: Dec. 5, 2014

(87) PCT Pub. No.: WO2013/181729

PCT Pub. Date: Dec. 12, 2013

(65) Prior Publication Data

US 2015/0137578 A1 May 21, 2015

(30) Foreign Application Priority Data

Jun. 5, 2012 (BR) ..... 102012013521

(51) Int. Cl.
*E21B 43/28* (2006.01)

(52) U.S. Cl.
CPC ..... *E21B 43/28* (2013.01)

(58) Field of Classification Search
CPC ..... E21B 43/28
USPC ..... 299/4, 5
See application file for complete search history.

(56) References Cited

U.S. PATENT DOCUMENTS 2,772,868 A * 12/1956 Brandt ..... B65G 5/00 299/5
2,994,200 A * 8/1961 Carpenter ..... E21B 43/28 299/5
3,262,741 A 7/1966 Edmonds et al.
3,391,962 A * 7/1968 Ruse ..... E21B 43/28 166/208
3,574,402 A * 4/1971 Davis, II ..... E21B 43/283 299/5
4,007,964 A 2/1977 Goldsmith
4,192,555 A 3/1980 Willett
4,232,902 A 11/1980 Cuevas
4,290,650 A 9/1981 Thompson
(Continued)

OTHER PUBLICATIONS

International Search Report, Brazilian Patent Application No. PCT/BR2013/000195 dated Apr. 16, 2014.

*Primary Examiner* — John Kreck
*Assistant Examiner* — Michael Goodwin
(74) *Attorney, Agent, or Firm* — Arent Fox LLP

(57) ABSTRACT

The present invention pertains to a mineral exploitation method and, more specifically, to a method for extracting potassium salts from underground deposits. In the method according to the present invention, an intermediary stage is carried out between the primary mining and secondary mining stages, and in this intermediary stage sinks (8) are created that receive the water-immiscible fluid (9) used in the primary mining stage, exposing an amount of potassium chloride remaining on the cavern ceiling, at the end of the primary mining stage, which will be dissolved by a second solvent during the secondary mining stage.

9 Claims, 4 Drawing Sheets

(56) References Cited

U.S. PATENT DOCUMENTS

| | | | | | |
|---|---|---|---|---|---|
| 4,411,474 | A | * | 10/1983 | Higgins | E21B 43/28 299/4 |
| 5,246,273 | A | | 9/1993 | Rosar | |
| 5,957,539 | A | * | 9/1999 | Durup | E21B 43/28 299/4 |

* cited by examiner

METHOD OF EXPLOITING POTASSIUM SALTS FROM AN UNDERGROUND DEPOSIT

CROSS-REFERENCE TO RELATED APPLICATION

This application is a National Stage entry of International Application No. PCT/BR2013/000195, filed Jun. 4, 2013, which claims priority to Brazilian Patent Application No. BR102012013521-3, filed Jun. 5, 2012, the disclosures of the prior applications are hereby incorporated in their entirety by reference

FIELD OF THE INVENTION

The present invention pertains to a mineral exploitation method and, more specifically, to an improved method for extracting potassium salts from underground deposits.

BACKGROUND OF THE INVENTION

Potassium occurs in nature in mineral deposits of potassium chloride (silvite) closely associated with sodium chloride (halite), forming mechanical mixtures in the form of deposits of soluble salts (silvinite) which form "coats" or "mantles" of different proportions of potassium chloride and sodium chloride.

Mineral deposits of potassium chloride and sodium chloride normally contain other substances, such as clays and salts (calcium sulfate, magnesium sulfate, magnesium chloride), and are deep, often exceeding 1,200 meters below the surface.

The deposits are known as evaporitic deposits and constitute the most important sources of potassium salts. These salts are highly soluble in water and can easily be exploited through dissolution techniques.

One of the exploitation methods of evaporitic deposits is known as "Exploitation by dissolution", where a solvent is injected into the "coat" of soluble salts through a first well and the brine produced is recovered through a second well.

The solvent used can be water, a diluted aqueous solution of potassium chloride, a diluted aqueous solution of sodium chloride, a diluted aqueous solution of sodium chloride and potassium chloride, or any other solution capable of dissolving, selectively or not, the potassium chloride (silvite) present in the ore.

During execution of the method, an underground cavern is developed and the shape of the cavern is controlled by injecting a water-immiscible liquid. This liquid may be, for example, a mineral oil, air, nitrogen, another inert gas, or any other fluid having a density lower than that of water at the temperature of executing the process.

The immiscible fluid creates an interface between the solvent and the cavern "ceiling" that prevents the dissolution of the ceiling and allows the cavern to grow sideways through the action of the solvent injected. Side (or horizontal) development of the cavern continues until the mineral coat is adequately mined and for as long as the cavern ceiling is stable.

Once horizontal development is exhausted, vertical development of the cavern begins. Accordingly, the injection point of solvent is raised, and the injection of immiscible fluid is controlled to stabilize the new ceiling. Hence, by way of successive horizontal "cuts" into the coat of potassium chloride to be mined, the vertical development of the cavern is carried out.

North American document no. U.S. Pat. No. 4,192,555 shows a method of exploitation of the state of the art. In this method, an aqueous solvent saturated in relation to sodium chloride and non-saturated in relation to potassium chloride is fed into an underground deposit of potassium chloride ore, such that the potassium chloride is dissolved and recovered. An insulating fluid is injected into the cavern so as to form a ceiling protection and allow the side development of the cavern and the processes of horizontal development and vertical development occur substantially as described above.

North American document no. U.S. Pat. No. 4,290,650 shows another method of exploitation of the state of the art, where two underground exploitation cavities are connected to form the cavern. During the formation of the cavities, the injection of solvent and the recovery of the brine occur through the single well associated to each cavity. Thus, each of the wells comprises a solvent input pipe and a brine output pipe.

The method of exploitation by dissolution of potassium chloride comprises two production phases: a continuous phase of "primary mining", where the extraction of sodium chloride and potassium chloride is carried out by the continuous injection of water, and a discontinuous phase or batch mining ("secondary mining" or "selective mining"), which occurs in continuation of primary mining, and where the potassium chloride is selectively extracted, by the injection of a solution sub-saturated in potassium chloride and saturated in sodium chloride, limiting the dissolution of additional sodium chloride.

The secondary mining mainly occurs on the walls of the cavern, giving continuity to the horizontal development. The production rate (measured in tons/hour) of the selective mining is lower than the production rate of the primary mining, and is most efficient in fully matured caverns, with large exposed dissolution surfaces.

In general terms, in a cavern explored using a conventional mining method by dissolution, about 80% of the potassium chloride is extracted by primary mining, while about 20% is extracted by secondary mining.

If we consider that exploitation by dissolution is carried out horizontally, and that the mineral coat or mantle generally presents a slight slant, at the end of the primary mining there are, on the cavern ceiling, portions of pure halite with a wedge of silvinite. Since said portions remain inaccessible by the solvent due to the presence of the immiscible fluid, this wedge of silvinite (and the potassium chloride contained therein) is not exploited during the secondary mining stage.

Hence, although the method described above is broadly and commonly used, the need remains for a method of exploitation capable of increasing the percentage of extraction of potassium chloride, chiefly in relation to secondary mining.

OBJECTIVES OF THE INVENTION

In light of the above, it is one of the objectives of the present invention to provide a method of exploitation of potassium salts having an efficiency superior to the methods known in the art.

It is another objective of the present invention to provide a method of exploitation of potassium salts that achieves a superior efficiency without increasing the environmental impact associated to exploitation.

It is yet another objective of the present invention to provide a method of exploitation of potassium salts that permits the extraction of potassium chloride remaining on the cavern ceiling of exploitation formed during the primary mining stage of potassium chloride.

SUMMARY OF THE INVENTION

The present invention achieves the above objectives by way of a method for exploiting potassium salts from an underground deposit, which comprises

- the injection, into a cavity generated in the underground deposit, of an is aqueous solvent of potassium salt and a water-immiscible fluid, through a pipe into a well in communication with the cavity, and
- the removal of a brine with the potassium salt dissolved through a second pipe in a well in communication with a cavity,
- where the action of the solvent allows the side expansion of the cavity to form a cavern and the water-immiscible fluid forms an insulating interface between the solvent and the cavern ceiling; and
- the gradual elevation of the injection point of the aqueous solvent of potassium salt and the water-immiscible fluid, so as to allow the vertical expansion of the cavern in a controlled manner, the side expansion of the cavern being repeated with each vertical elevation of the cavern;
- where, after the final elevation of the injection point of the solvent and the side expansion of the cavern at this point, there occurs the injection of water through orifices provided in the piping, so as to form a sink to receive the water-immiscible fluid which then flows from the ceiling of the cavern, and the injection of a second solvent to dissolve the potassium salt exposed after the water-immiscible fluid has flowed to the sinks.

In an embodiment of the method of the present invention, the first and second piping may be in a same well. However, in the preferred embodiment of the invention, the first pipe is in a first well and the second pipe is in a second well, and the injection of water through the orifices formed in the piping forms a sink in the ceiling around each one of the wells.

In a preferred embodiment of the present invention, the potassium salt is potassium chloride, the aqueous solvent of potassium chloride is water, and the water-immiscible fluid is crude oil. The second solvent is preferably a solution sub-saturated in potassium chloride and saturated in sodium chloride.

Further in the preferred embodiment of the present invention, the sinks are shaped like small conic or cylindrical caverns formed around the first and second wells.

DETAILED DESCRIPTION OF THE INVENTION

Figure 1:
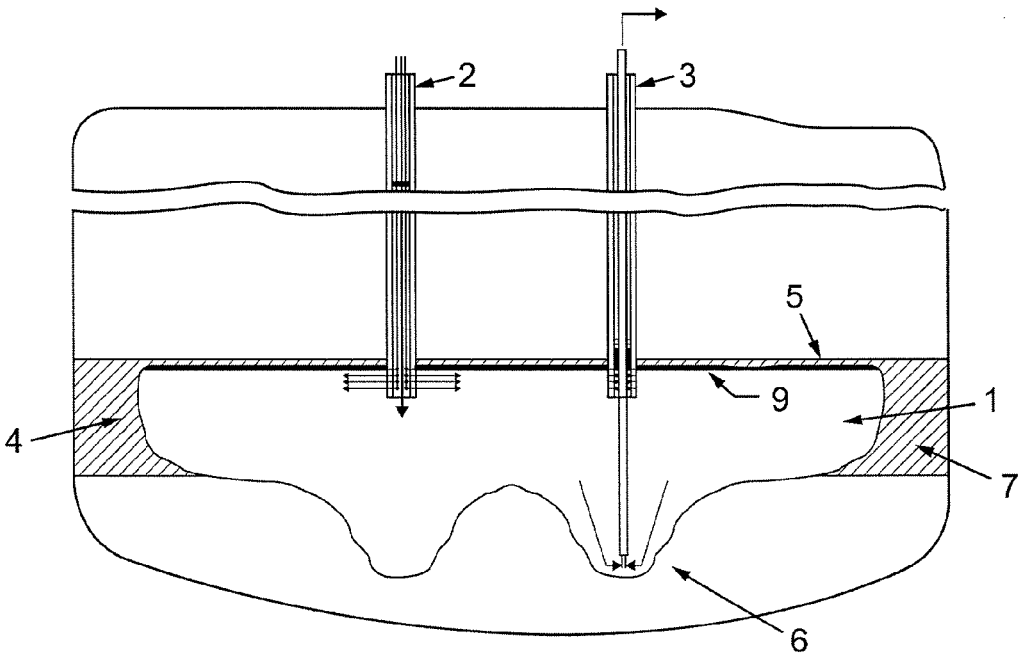
FIG. 1 illustrates a schematic view of a cavern formed during the exploitation of an evaporitic mineral deposit, showing the end of the primary stage of mineral exploitation.

The present invention will next be described in greater detail based on the examples of exploitation represented in the drawings. Although the detailed description uses the example of the mineral exploitation of potassium chloride, it must be understood that the method of the present invention is applicable to the exploitation of any soluble potassium salt, such as, for example, deposits of silvinite or carnallite.

FIG. 1 shows a cavern 1 in a configuration that corresponds to the final stage of the primary mining stage in a method of exploiting potassium chloride mineral (that is, in a configuration that corresponds to the most recent "vertical cut" during the vertical development of the cavern 1).

Figure 3:
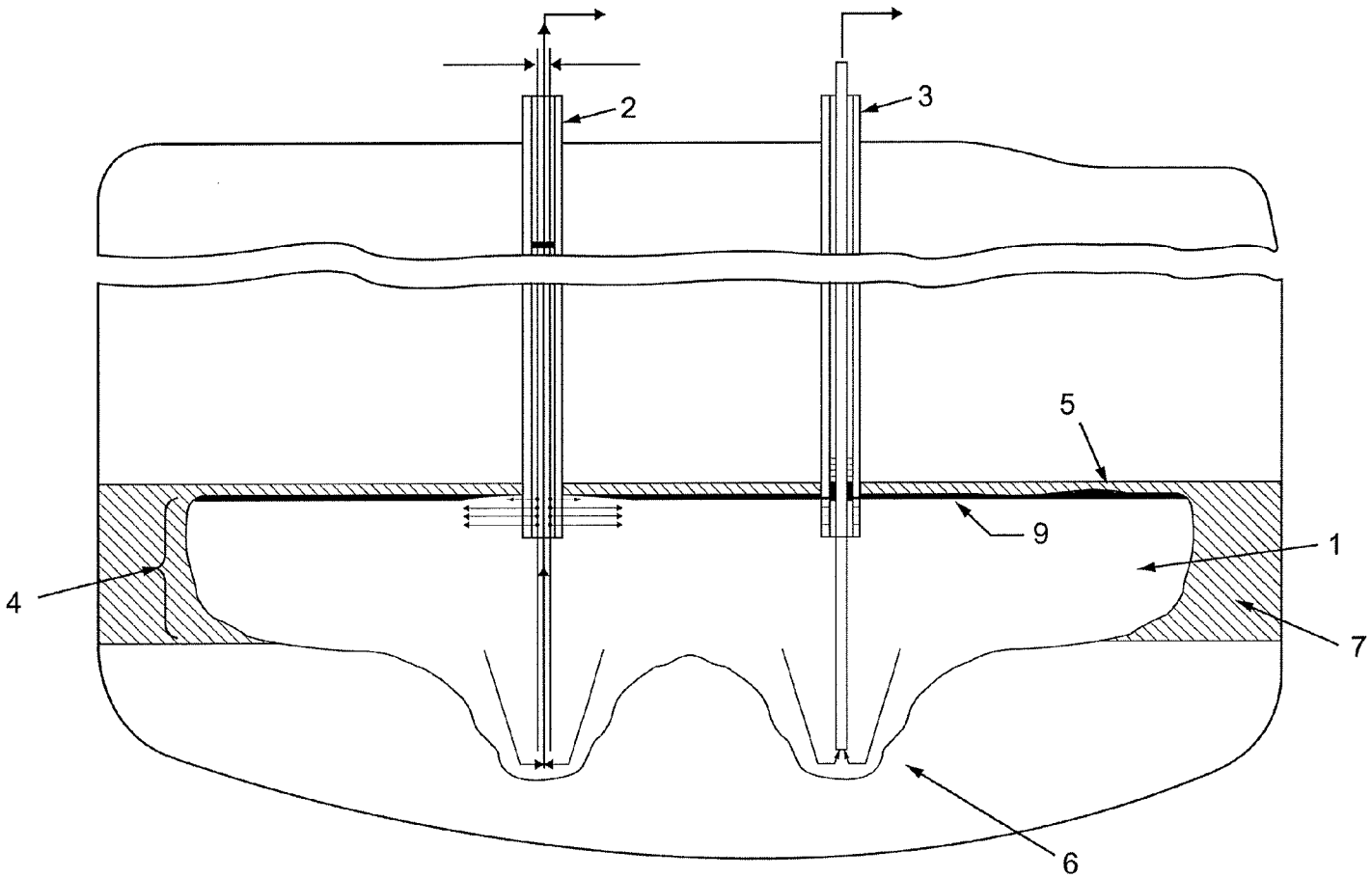
FIG. 3 is a schematic view of a cavern in an aspect where a first and second pipe are in the same well.

The primary mining phase of the method of the present invention follows the same stages of the method of the prior art, where a solvent is injected into the "coat" of soluble salts through a pipe 2 existing in a first well and the brine produced is recovered through a pipe 3 existing in a second well. However, it must be emphasized that the method of the present invention could equally be applied to an exploitation based on a single well (see, e.g., FIG. 3, left side), where the piping 2 and 3 are located inside a single well in communication with a cavity.

Preferably, the solvent used is water, but any other type of suitable aqueous solution could be used.

Hence, during the side development of the cavern, the solvent used dissolves the salts on the exposed walls of the cavern 1, expanding the cavity.

An immiscible fluid 9 is fed jointly with the water so as to prevent the dissolution of the cavern ceiling 5 during side development. Preferably, the immiscible fluid 9 is crude oil, but any other type of fluid could be used within the scope of the present invention.

Further according to the prior art, the vertical development of the cavern 1 occurs by way of the gradual elevation of the cavern ceiling 5, gradually vertically raising the injection point of the solvent and controlling the feed of immiscible fluid to stabilize the new ceiling.

FIG. 1 therefore corresponds to the configuration of most recent gradual elevation of the cavern ceiling 5. Thus, in this last stage of the primary mining, the solvent (water) is fed to the cavity and dissolves the salts present in the cavern wall 4, and the resulting brine is extracted through the pipe 3 whose entry is located near to the cavern floor 6. The immiscible fluid 9 remains on the ceiling 5 of the cavern, forming an interface that prevents contact between the solvent and the ceiling.

Figure 2:
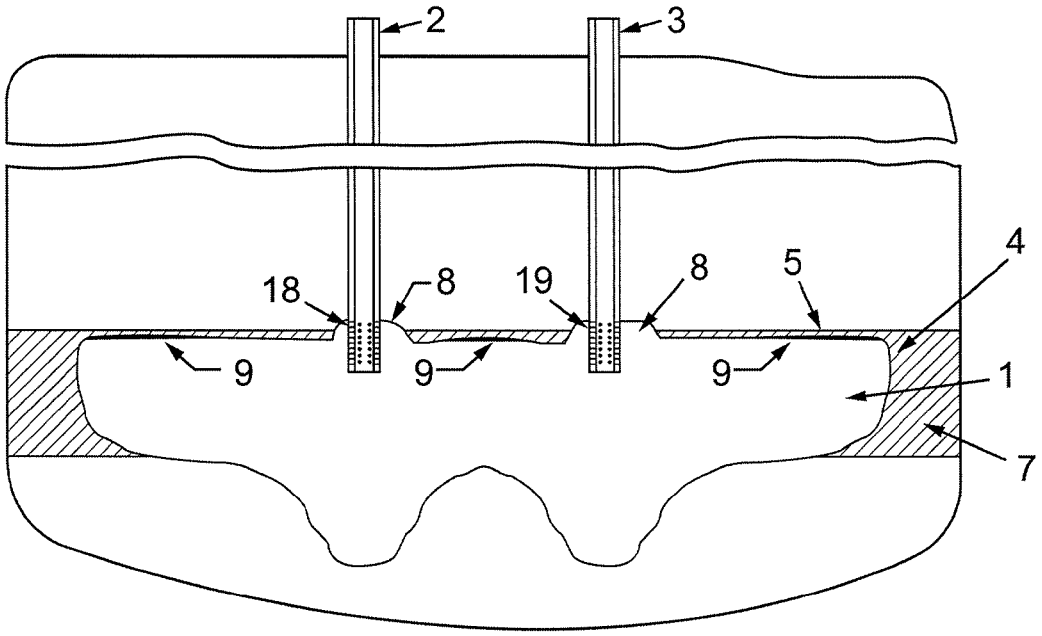
FIG. 2 illustrates a schematic view of a cavern formed during the exploitation of an evaporitic mineral deposit, according to the mineral exploitation method of the present invention.

As can be seen in FIG. 2, at the end of the primary mining, a mineral "wedge" 7 of potassium chloride remains in the cavern ceiling region. The formation of this wedge is due to the slanted character of the mineral mantle.

Figure 4:
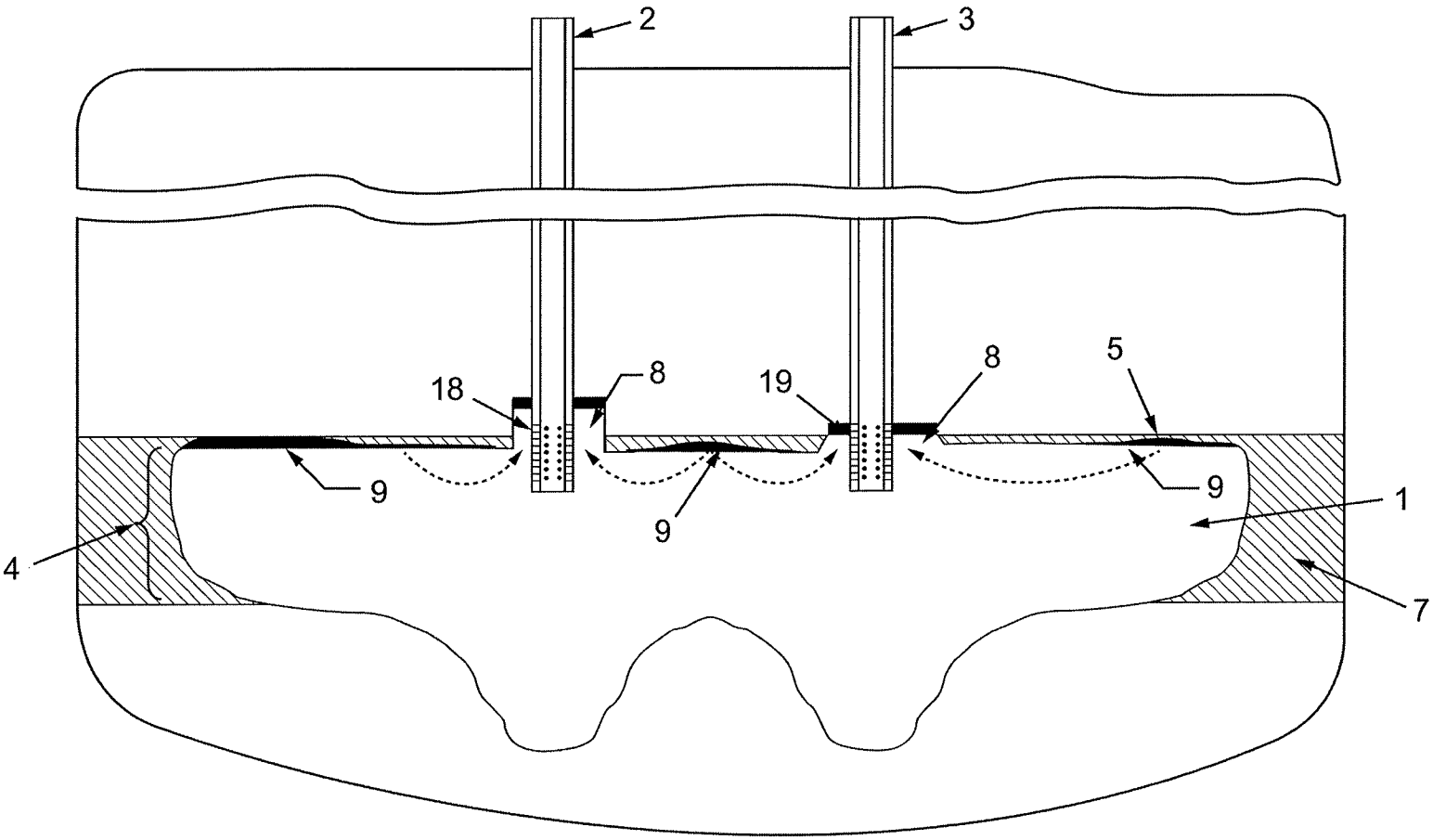
FIG. 4 is a schematic view of a cavern in an aspect where a sink comprises a cylindrical cavern.

Hence, to expose this mineral wedge 7 and allow greater efficiency of the secondary mining phase, the method of the present invention proposes the creation of sinks 8 of immiscible fluid. Such sinks 8 are formed in the regions adjacent to the wells of the piping 2 and 3 and are shaped like small conic caverns. It should be noted, however, that the sinks 8 could be any other suitable shape, such as, for example, cylindrical (see, e.g., FIG. 4).

To form the sinks 8, the piping 2 and 3 is drilled so as to form orifices 18 and 19 through which the water is injected which will dissolve the material, forming the conic sinks 8.

Drilling is preferably carried out using explosive charges in a procedure used widely in the oil and gas industry. In a simplified manner, explosives are lowered into the well as far as the site where the piping should be drilled, such that the jets of gases originating from detonation drill the piping.

Preferably, the water is injected through orifices 18 and 19 alternately, dissolving the mineral and creating the volumes from which the sinks 8 will originate.

Thus, in the preferred embodiment of the method of the present invention, firstly water is injected through the orifices 18 in the pipe 2 and, after a space of time, the water is injected through the orifices 19 in the pipe 3. When the water is injected through pipe 2, the brine is withdrawn through pipe 3 and when the water is injected through pipe 3, the brine is withdrawn through pipe 2.

The choice of water is due to the character of the mineral material, since water is the best dissolution agent for a mixture of soluble salts.

Since the ceiling 5 of the cavern 1 is not absolutely flat but rather slants towards the wells, the immiscible fluid 9 naturally migrates to the region of the sinks 8, exposing the ceiling 5 of the cavern 1.

Once the region of the cavern ceiling 5 is exposed, the secondary mining stage begins, and a suitable solvent (for example, a solution sub-saturated in potassium chloride and saturated in sodium chloride) is used to carry out the selective mining of the remaining potassium chloride.

Although theoretically the primary mining stage could continue until the mineral wedge on the cavern ceiling is fully exhausted, this method would lead to the dissolution of an additional amount of halite (sodium chloride, with low economic value) of the ceiling, which would increase the environmental impact of the process.

Based on the method proposed above, it is possible to expose the silvinite mineral wedge to the action of the solvent in the secondary mining, increasing the extraction efficiency of potassium chloride during the secondary mining.

It must be understood that FIGS. 1-4 show examples of a preferred embodiment of the method of the present invention, and the real scope of the object of the invention is defined in the accompanying claims.

The invention claimed is:

1. A method for exploiting potassium salts from an underground deposit, comprising:

injecting into a cavity generated in the underground deposit, an aqueous solvent of potassium salt and a water-immiscible fluid through a first pipe into a well in communication with the cavity;

removing a brine comprising dissolved potassium salt through a second pipe in a well in communication with the cavity, wherein the solvent and the water-immiscible fluid allows for side expansion of the cavity to form a cavern and wherein the water-immiscible fluid forms an insulating interface between the aqueous solvent and a ceiling of the cavern; and gradually elevating an injection point of the aqueous solvent and of the water-immiscible fluid to allow for vertical expansion of the cavern in a controlled manner, the side expansion being repeated periodically with vertical elevation of the cavern;

wherein, after a final elevation of the injection point and side expansion of the cavern:

water is injected through orifices perforated in the first pipe and the second pipe to form a sink on the cavern ceiling such that the water-immiscible fluid flows from the ceiling of the cavern into the sink, thereby exposing potassium salt at the cavern ceiling; and a solvent is injected to dissolve the exposed potassium salt after the sink has received the water-immiscible fluid.

2. The method of claim 1, wherein the first pipe and the second pipe are in a same well.

3. The method of claim 1, wherein the first pipe is in a first well and the second pipe is in a second well, and the injection of water through the orifices forms a sink around the first pipe and the second pipe.

4. The method of claim 1, wherein the potassium salt is potassium chloride.

5. The method of claim 4, wherein the deposit of potassium chloride is associated to sodium chloride, and the aqueous solvent is a solution sub-saturated in potassium chloride and saturated in sodium chloride.

6. The method of claim 1, wherein the aqueous solvent is water or a solution sub-saturated in potassium chloride and saturated in sodium chloride.

7. The method of claim 1, wherein the sink comprises a conical cavern.

8. The method of claim 1, wherein the sink comprises a cylindrical cavern.

9. The method of claim 1, wherein after the final elevation of the injection point and side expansion of the cavern and before the aqueous solvent is injected through the orifices, the orifices are drilled in a portion of the first pipe and the second pipe adjacent the cavern ceiling.

* * * * *